US005355554A

United States Patent [19]

Magoon

[11] Patent Number: 5,355,554

[45] Date of Patent: Oct. 18, 1994

[54] FLUSH DOOR PULL HANDLE AND MEANS FOR MOUNTING

[75] Inventor: Robert D. Magoon, Duluth, Ga.

[73] Assignee: Kawneer Company, Inc., Norcross, Ga.

[21] Appl. No.: 974,268

[22] Filed: Nov. 10, 1992

[51] Int. Cl.[5] ..... A47B 95/02

[52] U.S. Cl. ..... 16/124; 49/460

[58] Field of Search ..... 16/124, 110 R; 312/239, 312/332.1, 348.6; 49/460; D8 DIG. 1

[56] References Cited

U.S. PATENT DOCUMENTS

| | | | |
|---|---|---|---|
| 2,311,645 | 2/1943 | Dempsey et al. | 16/124 |
| 2,698,456 | 1/1955 | Duvall | 16/115 |
| 2,793,386 | 5/1957 | Muhlhauser | 16/124 |
| 3,236,204 | 2/1966 | Joseph | 49/460 |
| 3,412,421 | 11/1968 | Gerber | 16/124 |
| 3,775,808 | 12/1973 | Little | 16/124 |
| 5,134,754 | 8/1992 | Vickers | 16/124 |
| 5,231,948 | 8/1993 | Malmanger | 16/227 |

FOREIGN PATENT DOCUMENTS

| | | | |
|---|---|---|---|
| 25441 | 6/1963 | Fed. Rep. of Germany | 16/124 |
| 3437144 | 4/1986 | Fed. Rep. of Germany | 16/110 R |
| 1072545 | 3/1954 | France | 16/124 |
| 820754 | 9/1959 | United Kingdom | 16/124 |
| 2221151 | 1/1990 | United Kingdom | 16/110 R |

OTHER PUBLICATIONS

Special-Lite SL-82 Recessed Door Pull, Special-Lite, Inc., Decatur, Mich. (Feb. 1987).

FP459 Flush Pull, Trego Industries, Inc., Red Oak, Tex. (date unknown).

*Primary Examiner*—Lowell A. Larson
*Assistant Examiner*—Donald M. Gurley
*Attorney, Agent, or Firm*—Jones & Askew

[57] ABSTRACT

A flush mount door pull is disclosed which is secured within the face of a door in such a manner that there are no exposed fasteners. The disclosed flush mount door pull is further mounted in a manner which resists premature loosening of the fasteners and which substantially eliminates the possibility that the threads of the fasteners or of the threaded bores associated with the door pull will strip. In a further aspect of the invention, the disclosed flush door pull handle can be easily adapted to match the color and texture of the door panel within which it is mounted.

8 Claims, 6 Drawing Sheets

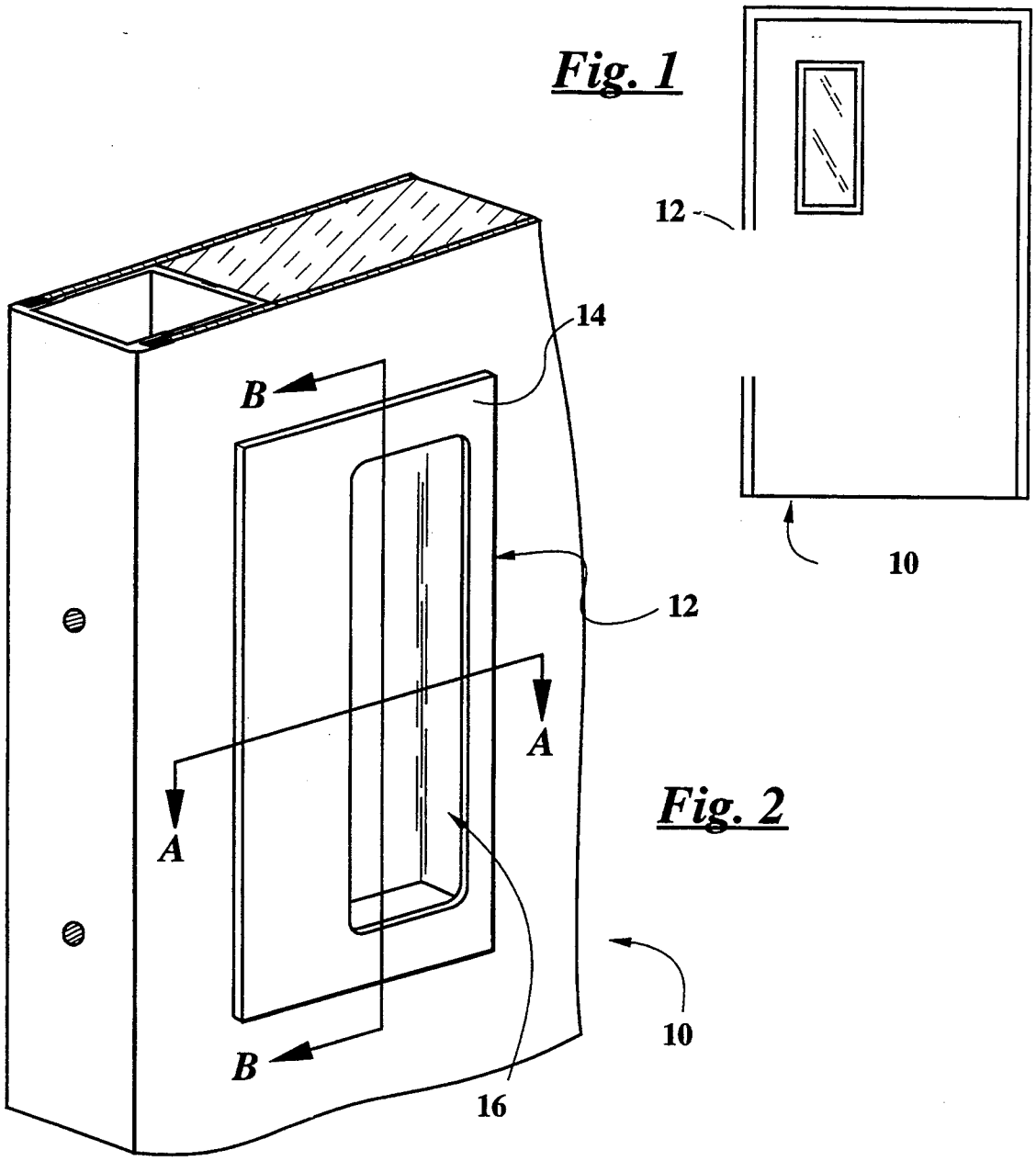
Fig. 1
Fig. 2
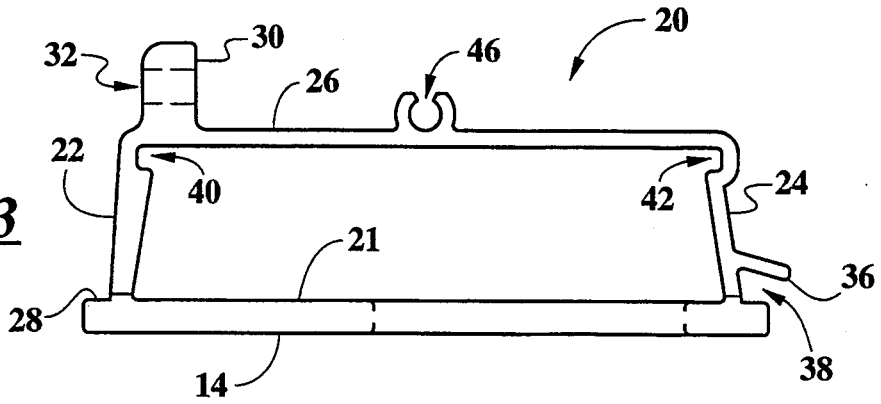
Fig. 3

FLUSH DOOR PULL HANDLE AND MEANS FOR MOUNTING

TECHNICAL FIELD

The present invention relates generally to door pulls and relates more specifically to a flush door pull handle and means for mounting.

BACKGROUND OF THE INVENTION

Flush door pull handles, also known as "recessed door pulls" or "pocket door pulls," are well known. Flush door pull handles are characterized by the pull being recessed into a pocket in the face of the door so as not to protrude from the door face. Such flush door pull handles are especially advantageous for installations such as hospital where a gurney or other equipment being rolled through an open door might catch on a protruding door pull. Flush door pull handles are also especially well suited for installations heavily used by children, since the absence of a protruding fixture makes it difficult for children to climb on or hang from the door pull handle.

When conventional flush door pull handles are recessed within a pocket in one face of a door, the door pull handle is typically secured to the door by fasteners inserted through the opposing face of the door and into the housing of the door pull. This mounting arrangement presents the primary disadvantage of flush mount door pulls in that the heads of the fasteners are exposed on the opposing door face and are aesthetically unpleasing. Further, the primary force exerted against the door pull is, at least initially, directed along the axis of the fasteners, placing considerable stresses on the threads of the fasteners and on the threads of the threaded bores associated with the door pull. These stresses lead to premature loosening of the fasteners securing the door pull within its pocket and, in extreme cases, can even cause the threads of the fasteners or of the threaded bores to strip.

Thus, there is a need for a flush mount door pull which does not require exposed fastener heads.

There is a further need for a flush mount door pull which avoids premature loosening of the fasteners securing the door pull within its pocket and which reduces the likelihood of the threads of the fasteners or of the threaded bores from stripping.

Another problem with prior art flush door pull handles concerns how to make the pull handle appear aesthetically pleasing. Most flush door pull handles are extruded from aluminum or other suitable metal and are installed with a bare metal finish. Thus the installed pull handles usually do not match either the color or the texture of the door panel within which they are mounted. Painting the pull handle can be difficult because of the recessed construction of the pull pocket. Finally, painting the pull handle does not address the problem of the texture of the finish.

Thus there is a need for a flush door pull handle which can easily be adapted to match the color and texture of the door panel within which it is mounted.

SUMMARY OF THE INVENTION

As will be seen, the present invention overcomes these and other problems associated with prior art flush mount door pulls. Stated generally, the present invention comprises a flush mount door pull which is secured within the face of a door in such a manner that there are no exposed fasteners. The flush mount door pull of the present invention is further mounted in a manner which resists premature loosening of the fasteners and which substantially eliminates the possibility that the threads of the fasteners or of the threaded bores associated with the door pull will strip. In another aspect of the present invention, the disclosed flush door pull handle can be easily adapted to match the color and texture of the door panel within which it is mounted.

Stated somewhat more specifically, the present invention comprises a door handle for flush mounting within a cutout formed in the face of a door. The door handle comprises a housing, means for engaging a first lateral edge of the housing with the cutout-defining wall remote from the lock stile, and means for engaging the opposed second lateral edge of the housing with the lock stile. In this manner the door handle can be mounted to the door without the need for exposed fasteners. In the disclosed embodiments the first lateral edge of the housing engages the cutout-defining wall remote from the lock stile by means of a channel formed on the first lateral edge of the housing which captures at least a portion of the cutout-defining wall remote from the lock stile therewithin. In a first disclosed embodiment the opposed second lateral edge of the housing is fastened to the lock stile with threaded fasteners inserted through the edge of the door. Further, the threaded fasteners are oriented substantially transverse to the direction of pulling forces exerted on said door handle. In this manner the load is exerted on the shaft of the fastener rather than upon only the threads thereof, and the fasteners are better able to resist stripping or premature loosening. In a second disclosed embodiment a clip is fastened to the lock stile within the cutout and is configured to engage the second lateral edge of the housing.

In another aspect, the present invention comprises a door handle for flush mounting within the face of a door which door handle receives a decorative panel mounted thereto. The door handle comprises a front panel having an opening formed therewithin. Opposed side panels have front edges attached to the front panel and extend rearward therefrom. Opposed channels are defined on mutually facing portions of the side walls, and the channels are configured to receive vertical edges of a decorative panel therewithin. In the disclosed embodiment the door handle further comprises top and bottom panels selectively mountable in fixed relation to the top and bottom edges, respectively, of the side panels. When the lateral edges of the decorative panel are slidably engaged within the opposed channels and the top and bottom panels are mounted to the door handle, the decorative panel is prevented from slidably disengaging from the channels.

In yet another aspect the present invention comprises a method for flush mounting to the face of a door a door handle comprising a pocket having a back wall the front surface of which is normally visible through an opening in the door handle. A section of the face of the door is cut out to create an opening dimensioned to receive at least a portion of the door handle therewithin. The section which was cut out of the face of the door is then mounted to conceal the front surface of the back wall of the pocket. In this manner the section of the face panel and not the back wall of the pocket is visible through the opening in the door handle. The insert section matches both the color and texture of the face of the door and thus provides an aesthetically pleasing appearance.

Thus, it is an object of the present invention to provide an improved flush mount door pull and means for mounting.

It is a further object of the invention to provide a flush mount door pull which does not require unsightly exposed fastener heads.

Still another object of the present invention is to provide a flush mount door pull and means for mounting which resists premature loosening of the fastening means.

It is yet another object of the present invention to provide an improved flush mount door pull which substantially eliminates the possibility that the threads of a fastener or of a threaded bore associated with the door pull will strip.

Another object of the present invention is to provide a flush mount door pull can be easily adapted to match the color and texture of the door panel within which it is mounted.

Still another object of the present invention is to provide a method for flush mounting a door pull to the panel of a door wherein the portion of the pocket of the door pull which is normally visible through the pull opening matches not only the color but also the texture of the door panel to which it is mounted.

Other objects, features, and advantages of the present invention will become apparent upon reading the following specification, when taken in conjunction with the drawings and the appended claims.

BRIEF DESCRIPTION OF THE DRAWINGS

FIG. 1 is a plan view of conventional door with a flush mount door pull according to the present invention mounted thereto.

FIG. 2 is an enlarged perspective view of the door handle of FIG. 1.

FIG. 3 is a top view of a housing of the flush mount door pull of the present invention.

DETAILED DESCRIPTION OF THE DISCLOSED EMBODIMENT

Figure 4:
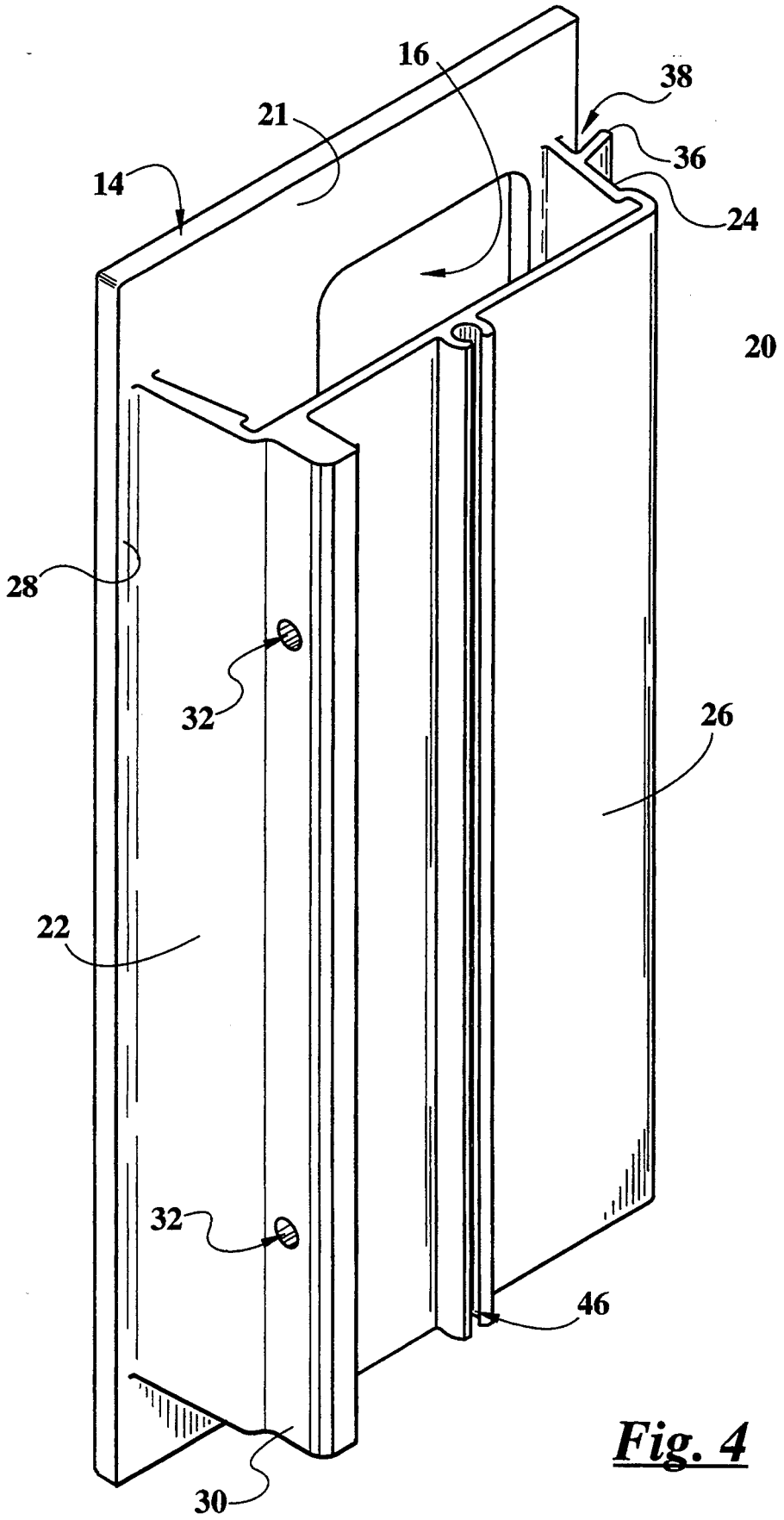
FIG. 4 is a rear isometric view of the housing of FIG. 3.

Referring now in detail to the drawings, in which like numerals indicate like elements throughout the several views, FIGS. 1 and 2 illustrate a conventional door 10 having mounted thereto a flush door pull handle assembly 12 according to the present invention. The door pull handle assembly 12 comprises a front panel or pull face 14 having a pull opening 16 formed therein. In the conventional manner, a user inserts his or her fingers through the pull opening 16, grasps the inner surface of the pull face 14, and pulls on the door pull handle 12 to open the door.

Referring now to FIGS. 3 and 4, the door pull handle assembly 12 comprises a housing 20 mounted to the back surface 21 of the pull face 14. The housing 20 and pull face 14 of the disclosed embodiment are formed as a unitary extrusion of aluminum or other suitable material. The housing 20 includes a mounting side wall 22, a pocketed side wall 24, and a housing back wall 26. The portion of the pull face 14 extending outwardly of the housing 20 defines a peripheral flange 28. The mounting side wall 22 includes a mounting flange 30 extending rearward therefrom. The mounting flange 30 comprises a pair of threaded bores 32 formed therein which extend substantially parallel to the pull face 14.

Adjacent the forward end of the pocketed side wall 24 but spaced rearward from the pull face 14, a hook member 36 extends outwardly and slightly forward. A channel 38 is formed between the hook member 36 and the peripheral flange 28 of the pull face 14. At the rear interior edges of the side walls 22, 24, a pair of inwardly facing opposed channels 40, 42 are formed. The channels 40, 42 provide a mounting means for a slide-in decorative panel, as will be more fully explained hereinbelow. A raceway 46 is formed on the housing back wall 26, the purpose and function of which will become apparent when the assembly of the door pull 12 is explained below.

Figure 5:
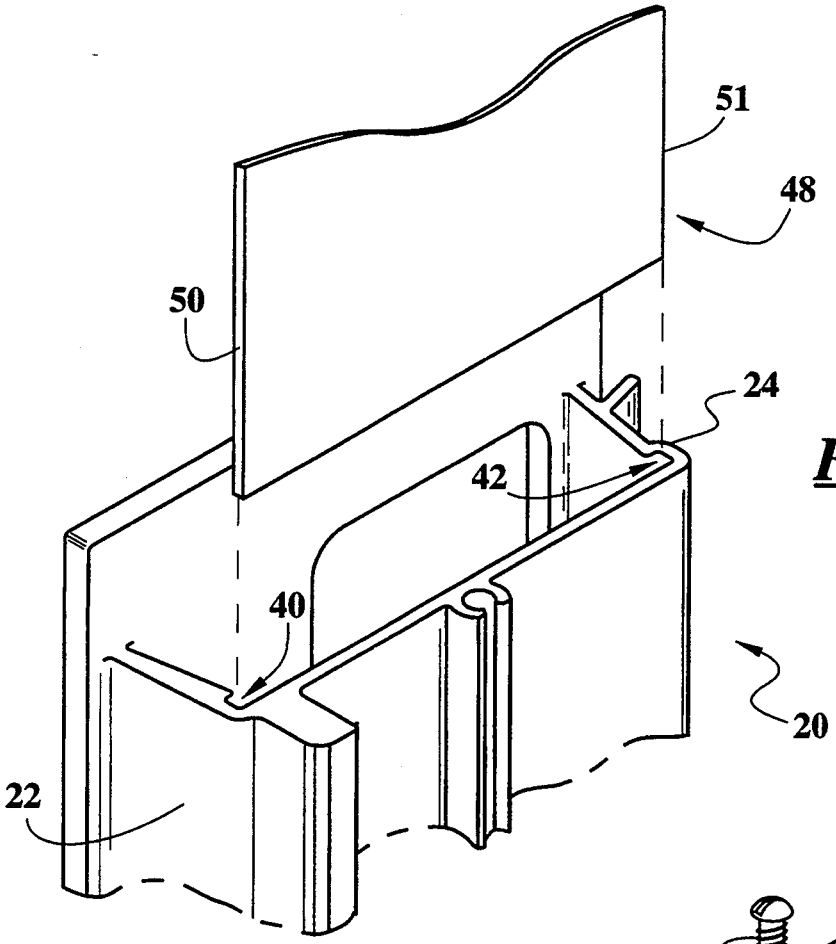
FIGS. 5 and 6 are partial rear isometric views of the housing of FIG. 3 illustrating the assembly of the flush mount door pull of the present invention.
Figure 6:
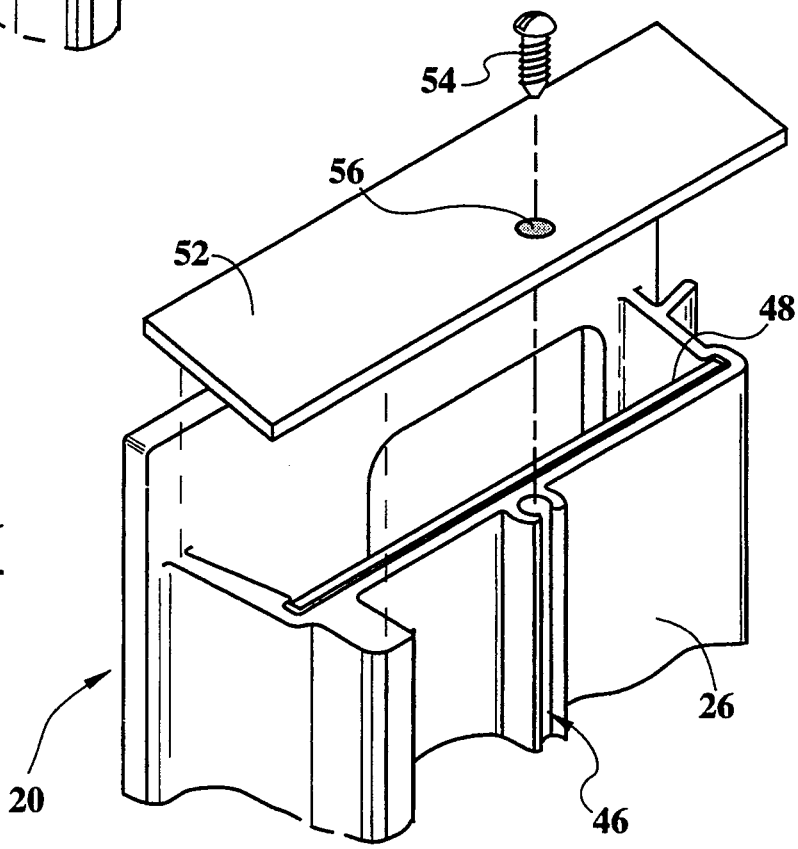

Referring now to FIGS. 5 and 6, the assembly of the door pull 12 in preparation for mounting to a door will be explained. Referring first to FIG. 5, a decorative insert panel 48 is slidably engaged with the housing 20. The vertical edges 50, 51 of the insert panel 48 are received within the channels 40, 42 formed on the interior faces of the side walls 22, 24. Then, with the decorative insert panel 48 in place as shown in FIG. 6, a top cap 52 is fastened to the upper end of the housing 20. A screw 54 is inserted through a hole 56 in the top cap 52 and threaded into the raceway 46 formed on the back wall 26 of the housing 20. In a similar manner, a bottom cap 58 (FIG. 11) is fastened to the lower end of the housing 20. With the top and bottom caps 52, 58 thus installed, the decorative insert panel 48 is captured within the housing 20.

Figure 7:
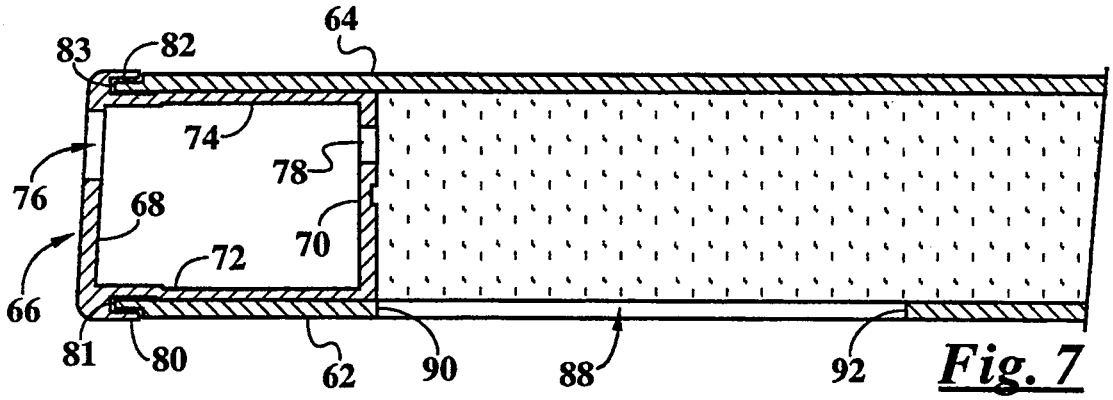
FIGS. 7–10 are cutaway views taken generally along line A—A of FIG. 2 illustrating the mounting of the door handle of the preferred embodiment.

FIGS. 7–11 illustrate the mounting of the assembled door pull 12 to a door 10. With reference first to FIG. 7, the door 10 comprises a front face 62, a back face 64, and a lock stile 66. The lock stile 66 is a tubular extrusion and comprises an exterior wall 68, an interior wall 70, a front wall 72, and a rear wall 74. A smooth bore 76 of diameter sufficient to permit the passage of the head of a fastener is formed in the outer wall 68 of the lock stile 66. A smaller smooth bore 78 of diameter sufficient to permit the passage of the shaft of a fastener but not the head thereof is formed in the interior wall 70 of the lock stile 66 coaxial with the larger smooth bore 76. A first hook member 80 captures the lock stile edge 81 of the front face panel 62 of the door 10. Similarly, a second hook member 82 captures the lock stile edge 83 of the rear face panel 64 of the door 10.

Referring still to FIG. 7, to prepare the door 10 to receive the door pull 12, a cutout or opening 88 is first made in the front face 62 of the door 10. The cutout 88 comprises a first wall 90 adjacent to the lock stile 66 and an opposed second wall 92 remote from the lock stile 66. The cutout 88 is dimensioned to receive the housing 20 of the door pull assembly 12 therethrough but not the pull face 14. The location of the cutout 88 on the front face 62 of the door 10 is such that the door pull assembly 12 installed within the cutout will have its threaded bores 32 coaxially aligned with the bores 76, 78 in the lock stile 66. In the preferred embodiment, a template (not shown) is provided to facilitate proper location of the cutout 88. The template has a first planar member which fits against the front face 62 of the door 10 and a second planar member perpendicular to the first planar member for engaging the edge of the door. A pair of pins projecting from the second planar member engage the preformed bores 76 in the outer wall 68 of the lock stile 66 to position to the template at the proper vertical location on the door 10. An aperture in the first planar member serves as a guide for a router or other suitable tool for cutting the opening 88. If the door 10 is a hollow door, performing the cutout 88 will complete preparation of the door. However, in the case of a foam-filled door, it will be necessary to route out the foam material immediately underlying the cutout 88 sufficient to accommodate the housing 20 of the door pull assembly 12.

Figure 8:
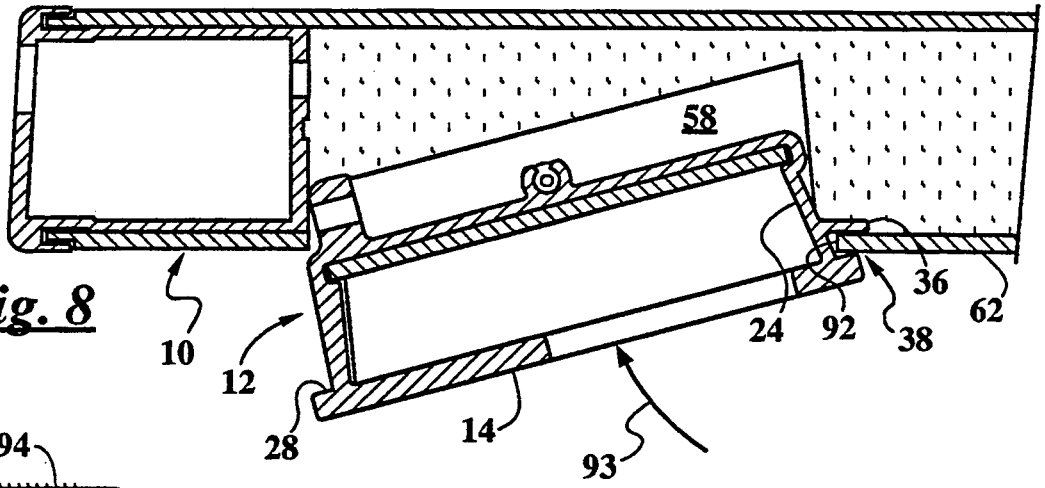

After the door 10 has been prepared, the door pull assembly 12 is angled with respect to the front panel 62 of the door, as shown in FIG. 8. The hook member 36 on the pocketed side wall 24 of the housing 20 is advanced behind the front panel 62 of the door 10. The wall 92 of the cutout 88 remote from the lock stile 66 is thus received within the channel 38 defined between the hook member 36 and the peripheral flange 28 of the pull face 14. The door pull assembly 12 is then pivoted around the hook member 36 in the direction indicated by the arrow until the peripheral flange 28 of the pull face 14 abuts the front face 62 of the door 10.

Figure 9:
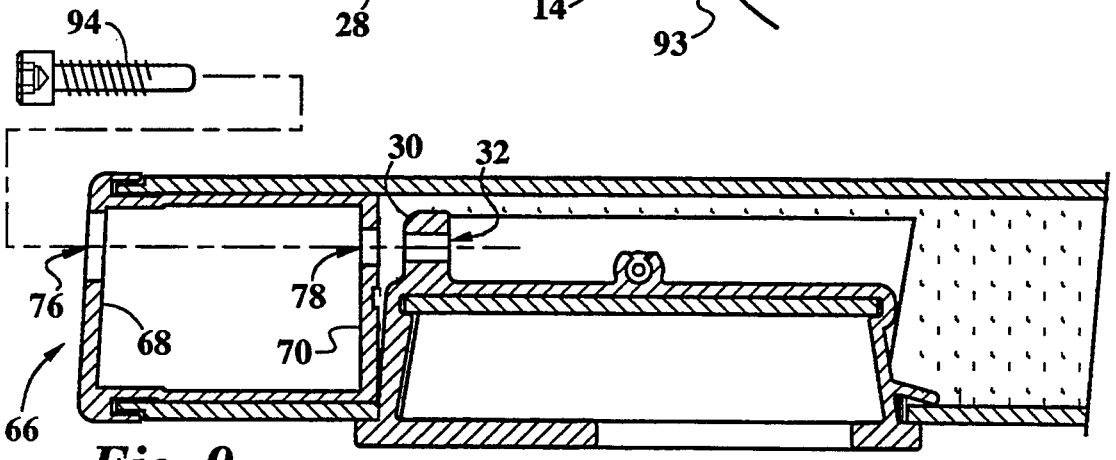

With the door pull assembly 12 thus placed within the cutout 88, the threaded bores 32 in the mounting flange 30 of the door pull assembly are coaxially aligned with the bores 76, 78 in the lock stile 66. As shown in FIG. 9, a threaded fastener 94 is inserted through the bore 76 in the outer wall 68 of the lock stile 66, and the shaft of the fastener is passed through the smaller bore 78 in the interior wall 70 of the lock stile 66 to engage the threaded bore 32 in the mounting flange 30 of the door pull assembly. When the fasteners 94 have been tightened, cap members 96 dimensioned to form a friction fit with the bore 76 in the outer wall 68 of the lock stile 66 are installed as shown in FIG. 10 to complete the assembly.

Figure 10:
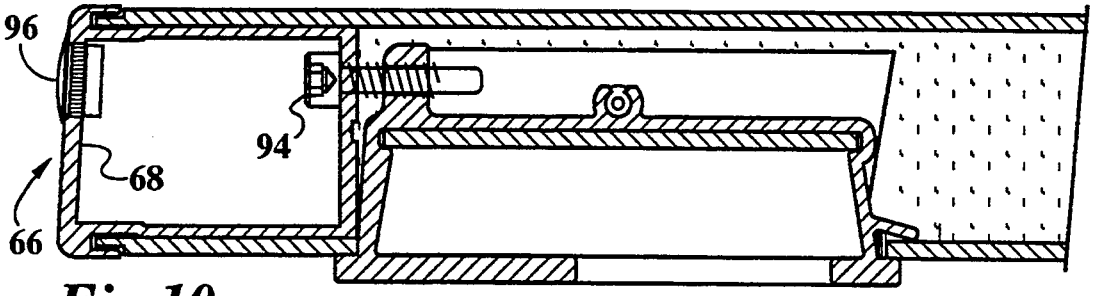
Figure 11:
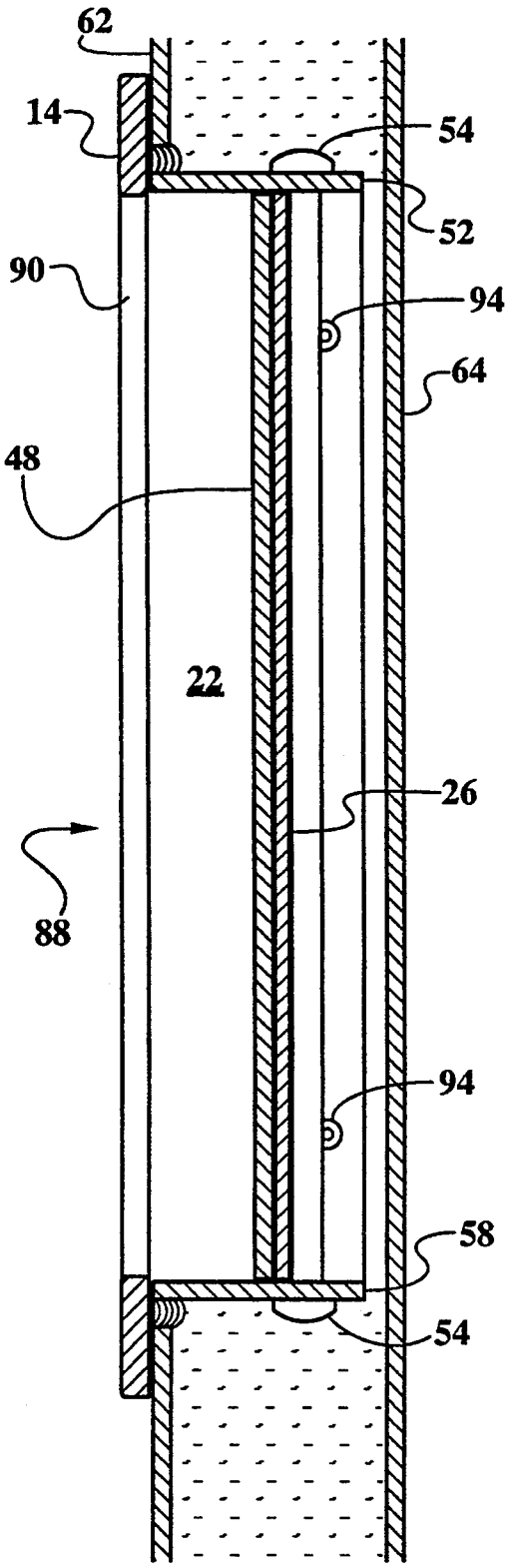
FIG. 11 is a side cutaway view taken along line B—B of FIG. 2.

The installed flush mount door pull assembly 12 shown in FIGS. 10 and 11 has a number of features. First, the door pull assembly 12 is mounted without any exposed fasteners. The only visible indications of the mounting means are the cap members 96 mounted on the exterior wall 68 of the lock stile 66. However, when the door 10 is closed, even these caps 96 are concealed from view. Thus, the door pull 12 provides an installation free from aesthetically displeasing exposed fastener heads.

Further, the fasteners 94 are oriented transverse to the direction of pull. Thus, the forces exerted on the fasteners 94 are borne by the shafts of the fasteners and not simply by the threads of the fasteners, as is the case in a conventional door pull mounting arrangement. By having the threaded fasteners 94 oriented transverse to the direction of pull, the fasteners are less likely to loosen prematurely and are more resistant to stripping of the threads of the fastener and of the threaded bore 32 in the housing 20 of the door pull assembly 12.

Figure 12:
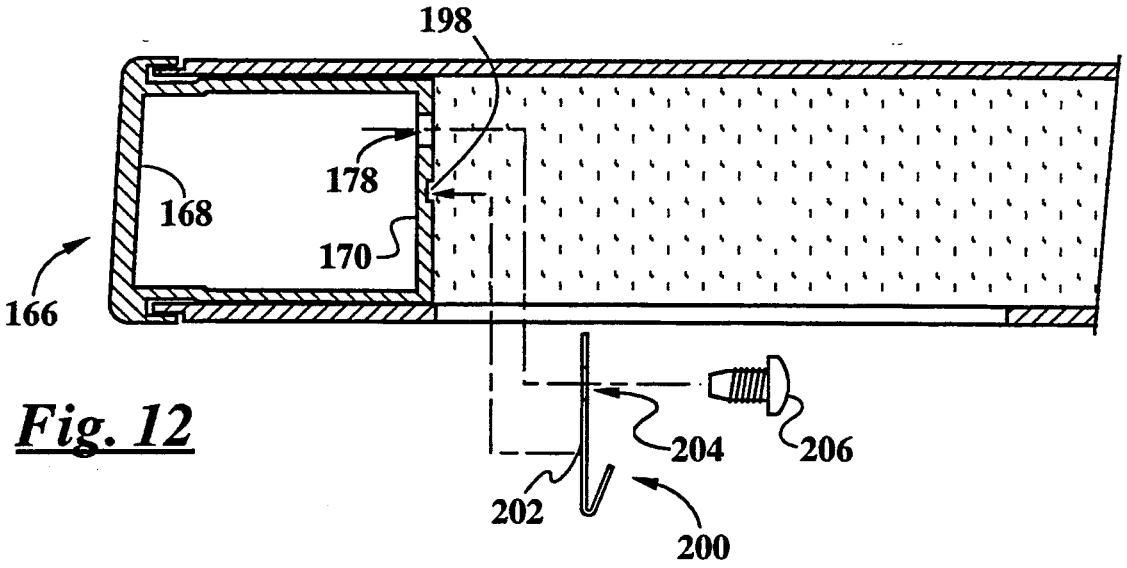
FIGS. 12–14 are top cutaway views illustrating an alternate embodiment of a flush mount door pull and mounting arrangement according to the present invention.
Figure 13:
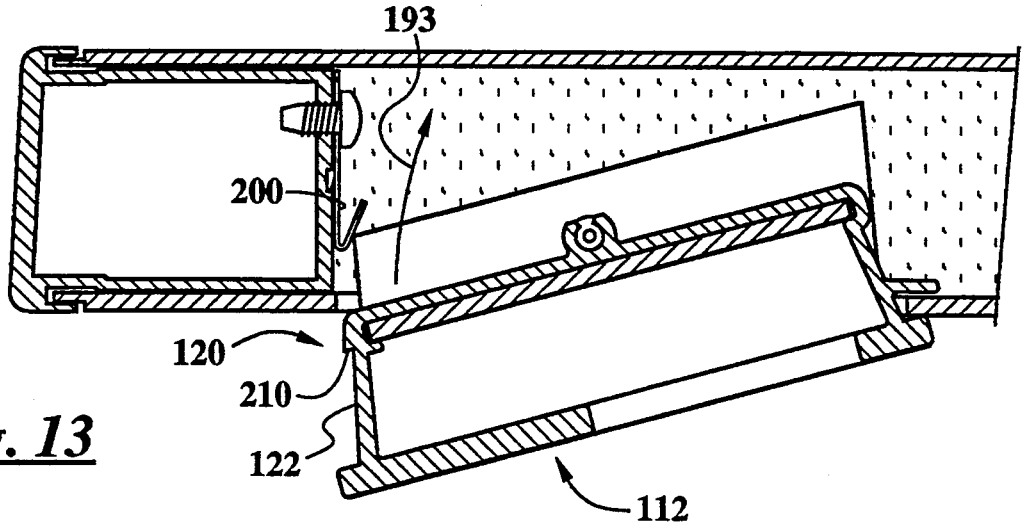
Figure 14:
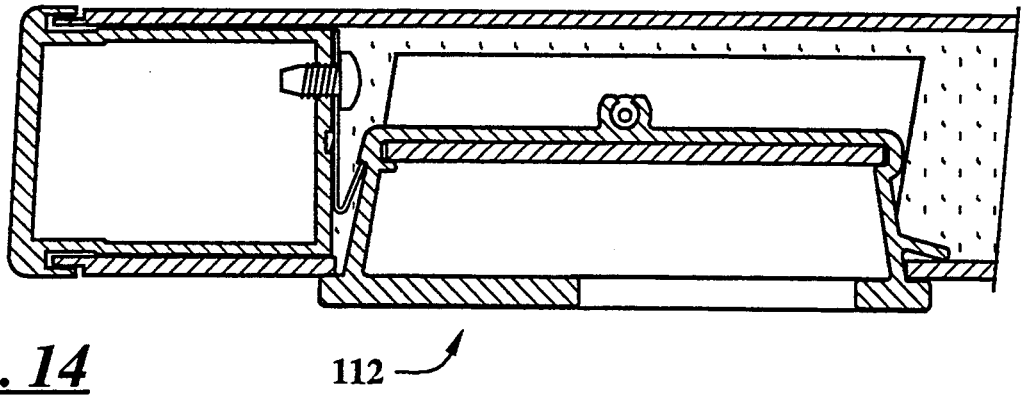

FIGS. 12–14 depict an alternate embodiment of a door pull assembly 112 according to the present invention. In the embodiment 112, the lock stile 166 does not have a bore formed in its exterior wall 168, and the bore 178 in the interior wall 170 of the lock stile 166 is threaded. Furthermore, a notch 198 is formed in the face of the interior wall 170 of the lock stile 166 which faces the pocket. A J-shaped clip 200 has a flange 202 formed thereon which engages the notch 198 in the face of the interior wall 170 of the lock stile 166. The J-shaped clip 200 has a hole 204 formed therethrough which aligns with the threaded bore 178 in the lock stile 166 when the flange 202 of the clip engages the notch 198. A threaded fastener 206 is inserted through the hole 204 in the clip 200 and threaded into the bore 178 in the lock stile 166 to fasten the clip in place.

Referring now to FIG. 13, the door pull assembly 112 differs from the door pull assembly 12 of the previous embodiment in that it lacks threaded bores for receiving the threaded shafts of mounting bolts. Instead, a lip 210 is formed on the mounting side wall 122 of the housing 120. When the door pull assembly 112 is pivoted into position in the direction indicated by the arrow 193, the J-shaped clip 200 snaps behind the lip 210 in the mounting side wall 122 of the housing 120 to retain the door pull assembly 112 in place.

It will be appreciated that the door pull assembly 112 of the alternate embodiment suffers one disadvantage over the door pull assembly 12 of the previous embodiment in that the door pull assembly 112, once installed, is very difficult to remove. However, the door pull assembly 112 of the alternate embodiment provides an advantage over the door pull assembly 12 of the previous embodiment in that there are no outwardly visible indications of the mounting arrangement even on the edge of the door.

A feature of both disclosed door pull assemblies 12, 112 is the provision of the opposed channels 40, 42 for retaining a decorative insert panel 50. As will be appreciated, the insert panel can be formed from any suitable material and can be of a color or texture which matches or contrasts with the front face 62 of the door 10. The insert panel 50 can even be fabricated from the portion of the front door panel 62 which is trimmed away to form the cutout 88. If desired, the panel 50 can also comprise a sign, such as a red sign with the word "EXIT" or the like printed thereon, which will be visible through the cutout 88 of the door.

Finally, it will be understood that the preferred embodiment has been disclosed by way of example, and that other modifications may occur to those skilled in the art without departing from the scope and spirit of the appended claim.

What is claimed is:

1. A door handle for flush mounting within the face of a door having walls defining a cutout therewithin, said door comprising a lock stile, and said cutout-defining walls including a first wall adjacent to said lock stile and an opposed second wall remote from said lock stile, said door handle comprising:

a front panel having opposing front and back surfaces and having an opening therethrough dimensioned to receive at least the fingers of a human hand, whereby a user can insert his fingers through said opening and grasp the back surface of said front panel to exert a pulling force thereagainst;

a housing attached to said back surface of said front panel and extending rearward therefrom, said housing having opposing first and second lateral edges;

means mounted to said housing for engaging said first lateral edge of said housing with said second wall remote from said lock stile when said housing is disposed within said cutout in said face of said door;

a threaded fastener; and a threaded bore formed on said second lateral edge of said housing such that when said housing is disposed within said cutout in said face of said door, said threaded fastener is selectively insertable through said lock stile and threadable into said threaded bore of said housing:

whereby said door handle is mountable to said door without the need for exposed fasteners.

2. The door handle of claim 1, wherein said means for engaging said first lateral edge of said housing with said second wall remote from said lock stile comprises a channel formed on said first lateral edge of said housing which captures said second cutout-defining wall therewithin.

3. The door handle of claim 1, wherein said threaded fasteners are aligned substantially parallel to said face of said door, whereby said threaded fasteners are oriented transverse to an initial direction of a pulling force exerted on said door handle.

4. A door handle for flush mounting within the face of a door, said door handle comprising:

a front panel having an opening formed therewithin;

opposed side panels each having front, rear, top, and bottom edges, said front edges of said side panels being attached to said front panel, and said side panels extending rearward from said front panel;

means defining opposed vertically extending channels on mutually facing portions of said side panels, said channels being configured to receive vertical edges of a decorative panel therewith;

a top cap member selectively mountable in fixed relation to said top edges of said side panels, said top cap member including means for blocking a decorative panel disposed within said opposed channels from becoming upwardly slidably disengaged from said vertically disposed channels when said top cap member is mounted to said top edges of said side panels; and a bottom cap member selectively mountable in fixed relation to said bottom edges of said side panels, said bottom cap member including means for blocking a decorative panel disposed within said opposed channels from becoming downwardly slidably disengaged from said vertically disposed channels when said bottom cap member is mounted to said bottom edges of said side panels.

5. An apparatus comprising:

a door having a face and a lock stile, said door having walls defining a cutout within said face of said door, and said cutout-defining walls including a first wall adjacent to said lock stile and an opposed second wall remote from said lock stile;

a front panel disposed against said face of said door and over said cutout within said face of said door, said front panel having opposing front and back surfaces and having an opening therethrough dimensioned to receive at least the fingers of a human hand, whereby a user can insert his fingers through said opening and grasp the back surface of said front panel to exert a pulling force thereagainst:

a door handle housing attached to said back surface of said front panel and extending rearward therefrom, said housing being disposed within said cutout, and said housing having opposing first and second lateral edges;

a channel formed on said first lateral edge of said door handle housing, said channel capturing said second cutout-defining wall therewithin; and a threaded fastener having a shaft which is received through said lock stile and threaded into said second lateral edge of said housing, whereby said door handle is mounted to said door without the need for exposed fasteners.

6. An apparatus comprising:

a door having a face and a lock stile, said door having walls defining a cutout within said face of said door, and said cutout-defining walls including a first wall adjacent to said lock stile and an opposed second wall remote from said lock stile;

a front panel imposed against said face of said door and over said cutout, said front panel having opposing front and back surfaces and having an opening therethrough dimensioned to receive at least the fingers of a human hand, whereby a user can insert his fingers through said opening and grasp the back surface of said front panel to exert a pulling force thereagainst;

a door handle housing attached to said back surface of said front panel and extending rearward therefrom, said housing being disposed within said cutout, and said housing having opposing first and second lateral edges;

a channel formed on said first lateral edge of said door handle housing, said channel capturing said second cutout-defining wall therewithin; and a clip mounted to said lock stile within said cutout and engaging said second lateral edge of said housing, whereby said door handle is mounted to said door without the need for exposed fasteners.

7. A door handle for flush mounting within the face of a door having walls defining a cutout therewithin, said door comprising a lock stile, and said cutout-defining walls including a first wall adjacent to said lock stile and an opposed second wall remote from said lock stile, said door handle comprising:

a front panel having opposing front and back surfaces and having an opening therethrough dimensioned to receive at least the fingers of a human hand, whereby a user can insert his fingers through said opening and grasp the back surface of said front panel to exert a pulling force thereagainst;

a housing attached to said back surface of said front panel and extending rearward therefrom, said housing having opposing first and second lateral edges;

means mounted to said housing for engaging said first lateral edge of said housing with said second wall remote from said lock stile when said housing is disposed within said cutout in said face of said door; and a clip mounted to said lock stile within said cutout and configured to engage and to retain said second lateral edge of said housing when said housing is inserted into said cutout;

whereby said door handle is mountable to said door without the need for exposed fasteners.

8. The door handle of claim 7, wherein said means for engaging said first lateral edge of said housing with said second wall remote from said lock stile comprises a channel formed on said first lateral edge of said housing which captures said second cutout-defining wall therewithin.

* * * * *